US009305474B2

(12) United States Patent
Spuzzillo et al.

(10) Patent No.: US 9,305,474 B2
(45) **Date of Patent: *Apr. 5, 2016**

(54) MOTORIZED GIFT PACKAGE ACCESSORY

(71) Applicant: American Greetings Corporation, Cleveland, OH (US)

(72) Inventors: Lauren Spuzzillo, Highland Heights, OH (US); Lauren Budzar, Seven Hills, OH (US); Allison Marsh, Olmsted Township, OH (US); Linda Marshall, Avon Lake, OH (US); Anthony Begin, Cleveland, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/635,970

(22) Filed: Mar. 2, 2015

(65) Prior Publication Data

US 2015/0170557 A1 Jun. 18, 2015

Related U.S. Application Data

(63) Continuation-in-part of application No. 13/828,200, filed on Mar. 14, 2013, now Pat. No. 9,044,990, which is a continuation-in-part of application No. 13/447,403, filed on Apr. 16, 2012, now Pat. No. 9,009,998, which is a continuation-in-part of application No. 12/940,145, filed on Nov. 5, 2010, now Pat. No. 8,230,624.

(60) Provisional application No. 61/286,184, filed on Dec. 14, 2009.

(51) Int. Cl.

| | |
|---|---|
| ***G09F 1/08*** | (2006.01) |
| ***G09F 19/02*** | (2006.01) |
| ***B42D 15/02*** | (2006.01) |
| ***B42D 15/00*** | (2006.01) |
| *H04R 1/02* | (2006.01) |

(52) U.S. Cl.

CPC ..... *G09F 19/02* (2013.01); *B42D 15/0093* (2013.01); *B42D 15/022* (2013.01); *H04R 1/028* (2013.01); *H04R 2400/00* (2013.01)

(58) Field of Classification Search

CPC ..... B42B 15/022; G09F 1/00; G09F 19/08; G09F 25/00

USPC ..... 40/124.03

See application file for complete search history.

(56) References Cited

U.S. PATENT DOCUMENTS 5,138,779 A 8/1992 Earnest
6,460,277 B1 * 10/2002 Tower ..... A44C 3/001 40/1.5
7,080,473 B2 7/2006 Kay (Continued)

*Primary Examiner* — Shin Kim
(74) *Attorney, Agent, or Firm* — Christine Flanagan

(57) ABSTRACT

The motorized gift package accessory of the present disclosure and related inventions include a base portion, which can be attached, adhesively or otherwise, to a gift package, such as a gift box. An accessory portion is attached to the base portion and contains one or more mobile elements which can be set in motion by a small or miniature motor. User interaction with the motorized gift package accessory is required to initiate the motor which in turn effects movement of the one or more mobile elements.

20 Claims, 6 Drawing Sheets

(56) References Cited

U.S. PATENT DOCUMENTS

| | | | | |
|---|---|---|---|---|
| 7,416,467 | B2 | 8/2008 | Avdellas | |
| 7,600,336 | B2 | 10/2009 | Hermanson et al. | |
| 7,722,431 | B2 * | 5/2010 | Sullivan | A63H 3/10 40/411 |
| 7,806,745 | B2 | 10/2010 | Hohl | |
| 8,490,306 | B2 * | 7/2013 | Guo | B42D 15/022 40/124.03 |
| 9,044,990 | B2 * | 6/2015 | Coughlin | B42D 15/022 |
| 2007/0153638 | A1 | 7/2007 | Lebbing et al. | |

* cited by examiner

MOTORIZED GIFT PACKAGE ACCESSORY

RELATED APPLICATIONS

This application is a continuation-in-part of Ser. No. 13/828,200 filed on Mar. 14 2013, which is a continuation-in-part of U.S. patent application Ser. No. 13/447,403, filed on Apr. 16, 2012, which is a continuation-in-part of U.S. patent application Ser. No. 12/940,145, filed on Nov. 5, 2010 (now U.S. Pat. No. 8,230,624, issued on Jul. 31, 2012), which is a non-provisional of U.S. Provisional Patent Application No. 61/286,184, filed on Dec. 14, 2009. A copy of each of the above-referenced patent documents is incorporated herein by reference in its entirety.

FIELD OF THE INVENTION

The present invention relates to gift package accessories or novelty items having one or more mobile parts which are powered by a miniature motor.

SUMMARY OF THE INVENTION

The motorized gift package accessory of the present disclosure and related inventions include a base portion, which can be attached, adhesively or otherwise, to a gift package, such as a gift box. An accessory portion is attached to the base portion and contains one or more mobile elements which can be set in motion by a small or miniature motor. User interaction with the motorized gift package accessory is required to initiate the motor which in turn effects movement of the one or more mobile elements.

DETAILED DESCRIPTION OF PREFERRED AND ALTERNATE EMBODIMENTS

Figure 2:
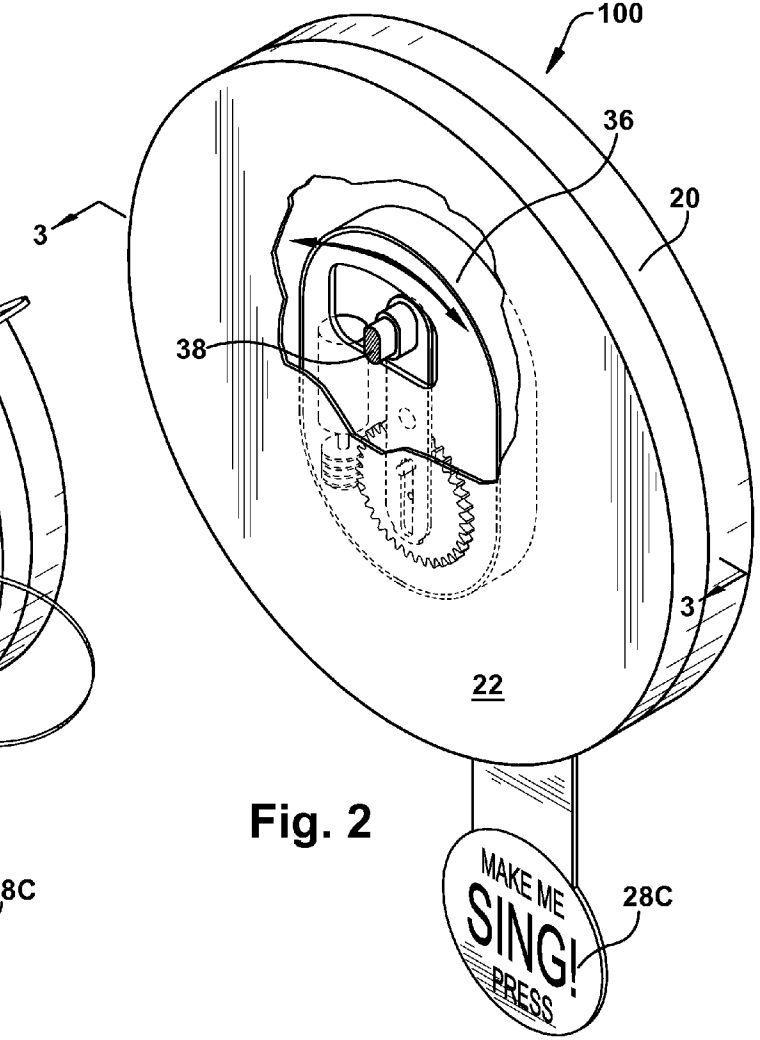
FIG. 2 is a perspective tear-away view of the motorized gift package accessory of FIG. 1.

The motorized gift package accessory of the present disclosure and related inventions contains a gift package adornment containing moveable elements combined with sound and motor modules which increase the surprise, entertainment and enjoyment value of a traditional gift package, such as a gift box, envelope, bottle, or any other such gift container. The gift package accessory contains a base 20 and a mobile attachment 24. The base 20, in a preferred embodiment, is made of foam, although any other lightweight material can be used. In the preferred embodiment, the base 20 is circular shaped having two separate circular foam pieces attached together using glue or other adhesive. Each of the foam pieces may have openings or cavities therein to accommodate the electronic and other components of the sound and motor modules. These components may include, but are not limited to: a circuit board 30, an integrated circuit, a power source 32, a speaker 34, a motor 36, and any other component which is required or which facilitates or improves storage and playback of digital audio and physical movement of a moveable object. These components are well known to one having skill in the art. A thin, planar paper or paper-like material 22 may be attached, adhesively or otherwise, to the outward planar surfaces of the two foam pieces which comprise the base structure 20. The planar material 22 located at the bottom of the base structure, opposite the mobile attachment 24, may contain an adhesive thereon with removable backing layer to facilitate attachment of the motorized gift accessory 100 to a gift package or other item. Although the base structure 20 is described as being two separate, circular pieces of foam, it may alternatively be a single piece of foam with one or more cavities therein and it may take any conceivable shape. In a preferred embodiment, the base structure 20 may have a diameter of between 3 and 6 inches. The motor 36 may be of the type having a rotating gear mechanism that when activated turns a circular gear. A connecting rod is located between and connects the gear and the mobile object or element (through a hole or aperture in the base structure). As the gear is rotated by the gear mechanism, it in turn causes movement of the connecting rod and the mobile object 24 attached thereto. Alternatively, the motor 36 may be of the type having a rotating arm or shaft, which may be an offset shaft which creates oscillatory motion upon rotation of the shaft by the motor. A lightweight movement mechanism is attached at one end to the rotating arm of the motor and at an opposite end to the mobile object. The motor 36 may be of any type able to effect motion in a small, lightweight mobile object. In a preferred embodiment, the motor 36 is activated by a press-button switch 28. The press-button 28 is located outside of the base structure 20 and is enveloped or surrounded by a structure or material 28C which conceals the actual press-button 28 and the wires connecting the press-button 28 to the internal electronic components contained within the base structure 20. The material 28C surrounding the press-button 28 may be the same as or different from the material encasing the wires. The material 28C over the press-button 28 may contain printing thereon instructing the user to "Press Here"; "Make Me Sing"; "Make Me Dance"; or other such phrases instructing the user where to press to effect movement of the mobile accessory. In addition to initiating the motor module, the press-button 28, in a preferred embodiment, also initiates the sound module. The sound module contains at least one audio file contained on a memory device. When the press-button 28 is pressed, it activates both the motor and sound module, effecting movement of the mobile object 24 and replay of the at least one audio file through a speaker 34. The audio file may contain spoken word, instrumental music, lyrics sung along with background music, sound effects or any other recordable sound. In an alternate embodiment, two separate switches may separately control activation of the sound and motor modules. The two separate switches may both be of the same type or different types. Other switches which may be used in place of or in addition to the press-button switch include, but are not limited to: a slide switch; a contact switch; a touch-sensitive switch; a sound-sensitive switch; a light-sensitive switch; a motion-sensitive switch; and a ball or tilt switch.

Figure 1:
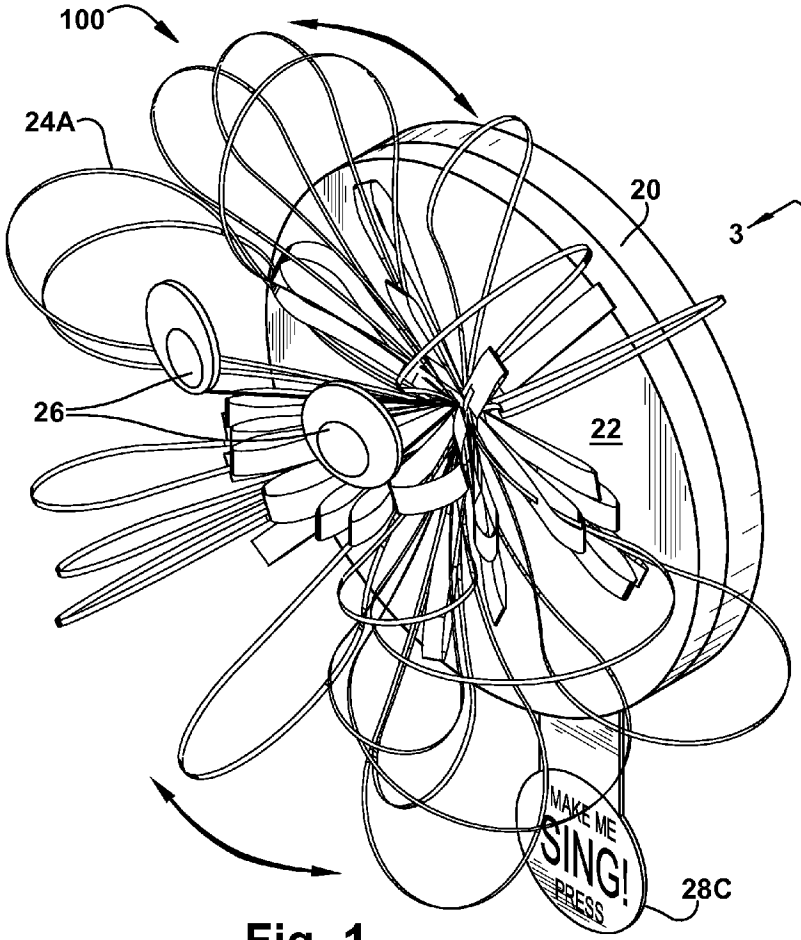
FIG. 1 is a perspective view of a first embodiment of the motorized gift package accessory of the present invention.
Figure 3:
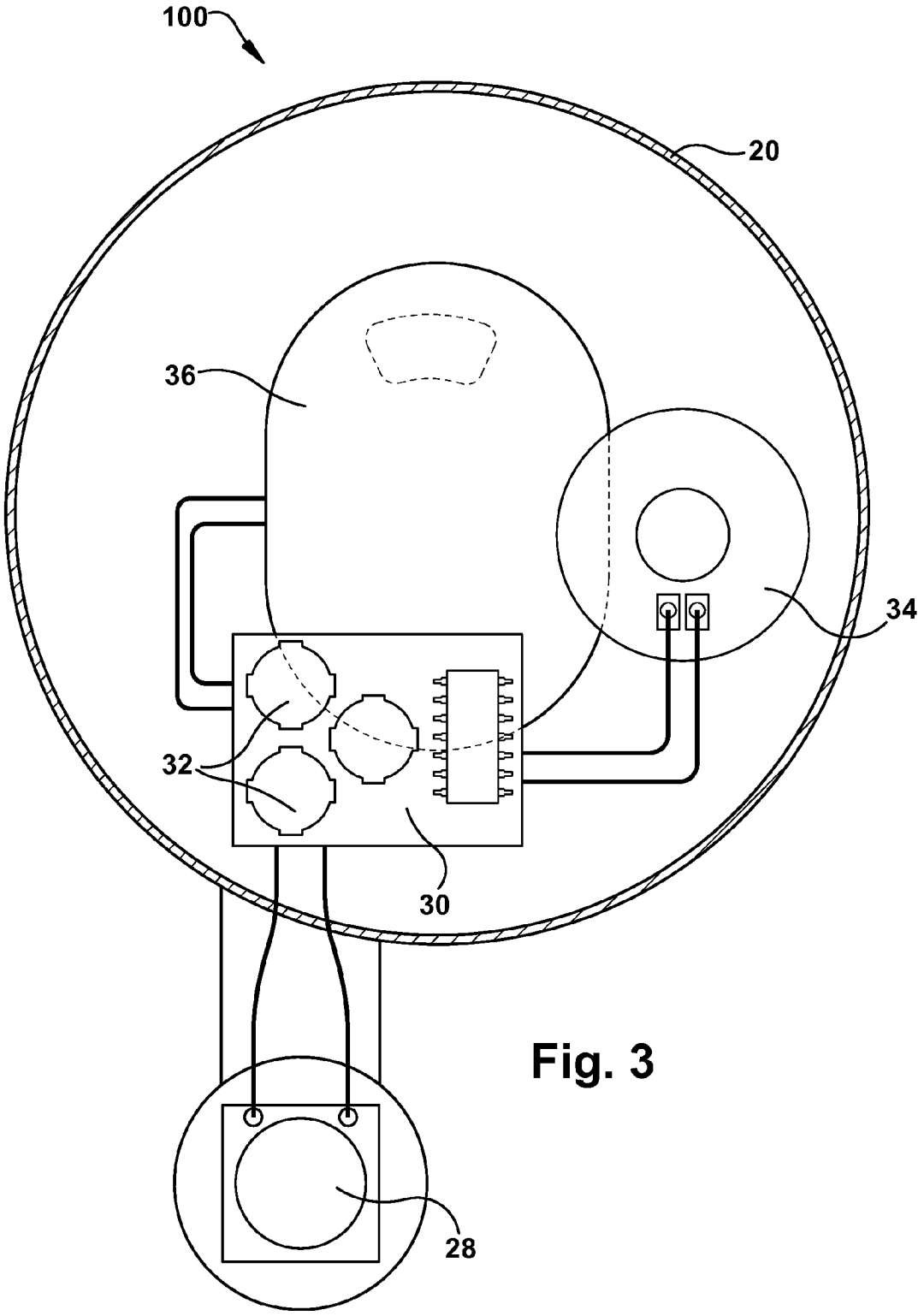
FIG. 3 is a front internal view of the motorized gift package accessory of FIG. 1.

In a first embodiment, shown in FIGS. 1 through 3, the mobile accessory portion 24 of the motorized gift package accessory 100 of the present invention is in the form of a decorative bow having various interlaced ribbons or other material with various knots, loops, ties, twists, ringlets, loose ends, or other decorative arrangements. The bow 24A may also contain additional adornments such as die cut shapes, moving googly eyes 26 (clear hard plastic shell with a smaller black disk trapped therein, used to imitate eyeballs), or any other decorative accessory. The bow 24A is connected at one end to an attachment arm or mechanism 38 which is also attached, at an opposite end, to the motor 36. Alternatively, the bow 24A may be connected directly to the motor 36. When the motor 36 is activated, the bow 24A may move in a circular, twisting, back-and-forth, up-and-down, vibrating, bouncing, or other type of motion, while audio plays simultaneously through the speaker 34. The audio or movement may automatically stop after a certain amount of time has passed or pressing the press-button 28 a second time may be required to stop the audio and movement of the bow 24A. While this embodiment of the motorized gift package accessory 100 has been described herein as a bow 24A and in terms of a particular size and shape, other decorative structures in other sizes or shapes have been contemplated and are considered to be within the scope of the present invention.

Figure 4:
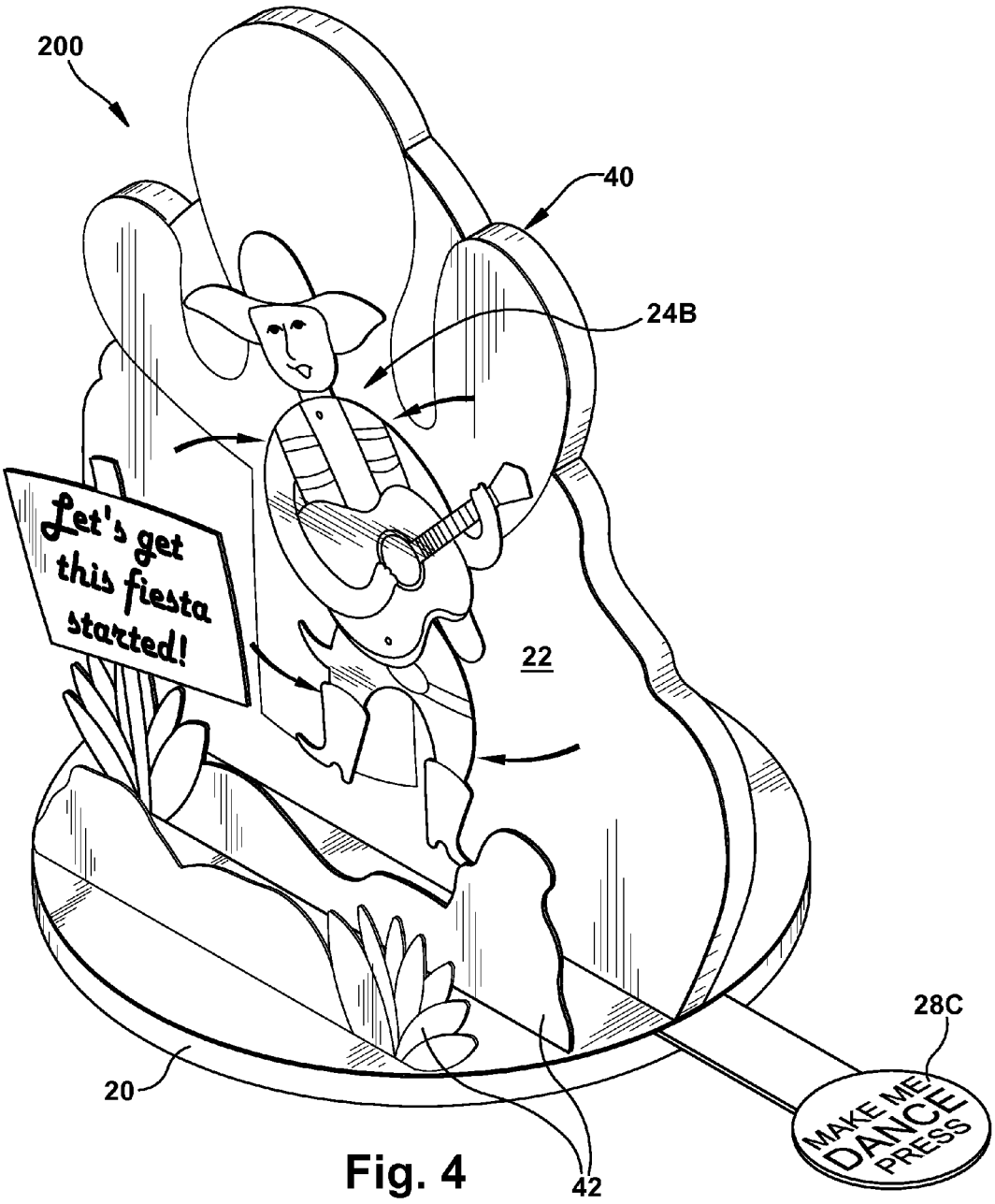
FIG. 4 is a perspective view of a second embodiment of the motorized gift package accessory of the present invention.
Figure 5:
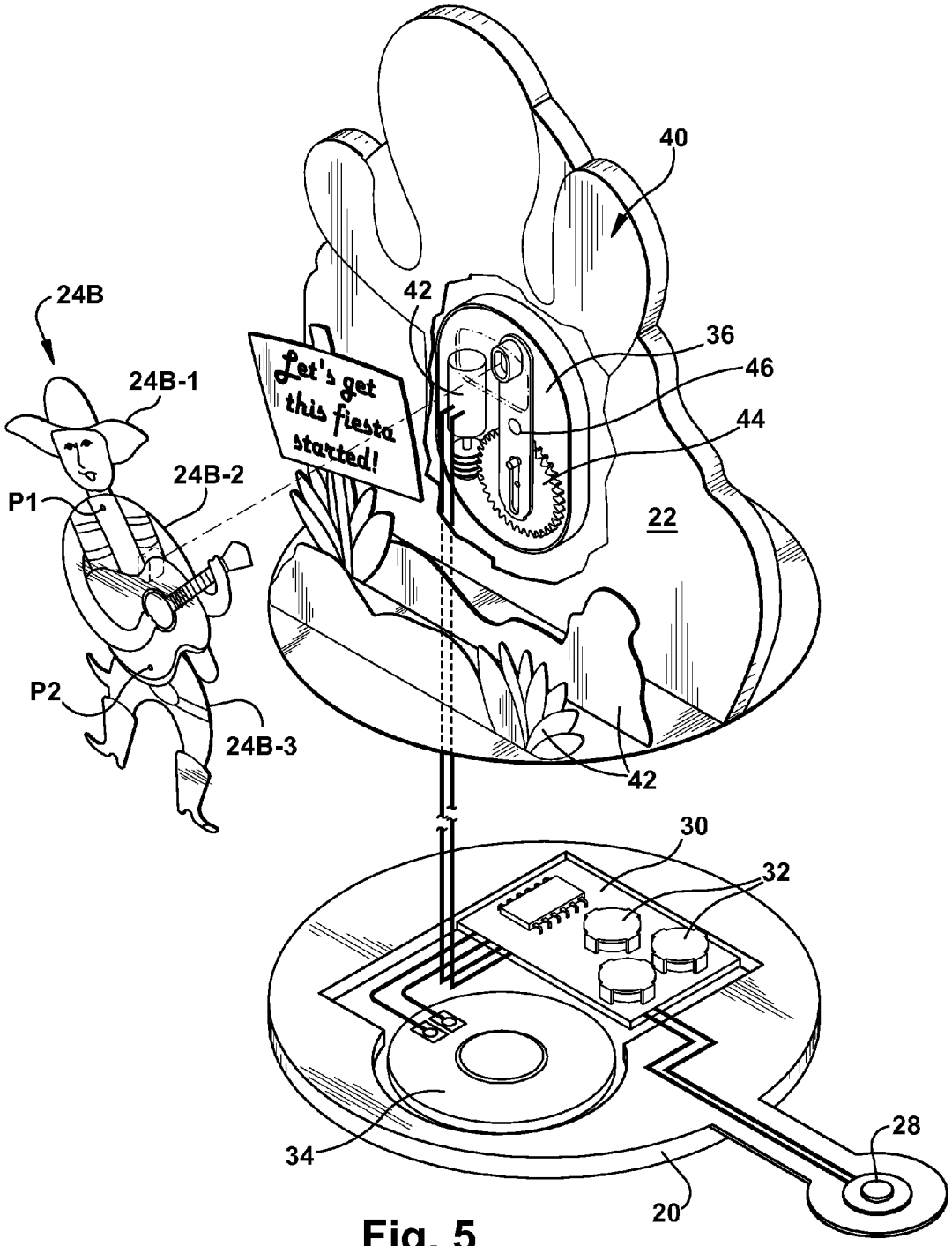
FIG. 5 is a perspective exploded view of the motorized gift package accessory of FIG. 4.
Figure 6:
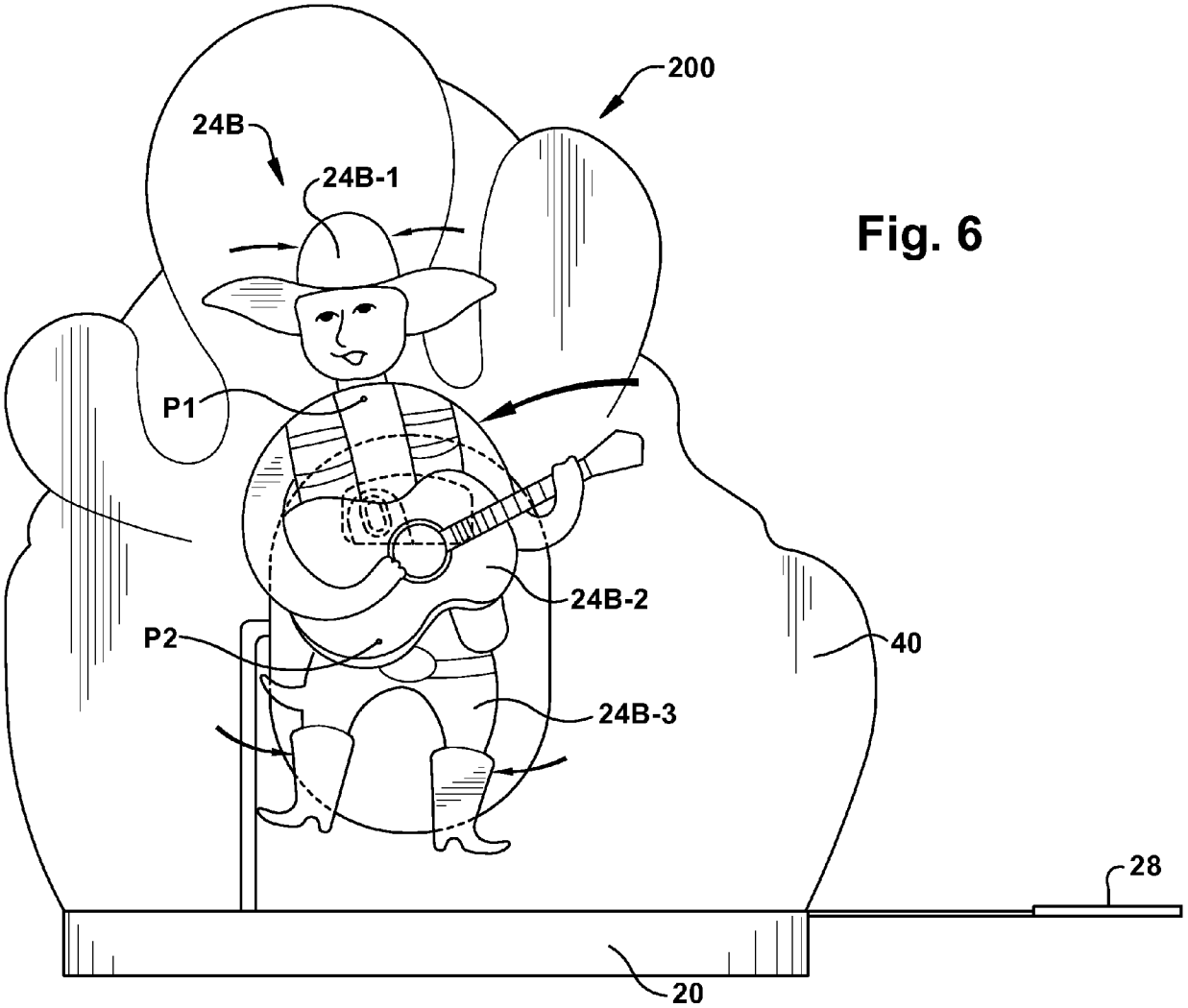
FIG. 6 is a front view of the mobile object of the motorized gift package accessory of FIG. 4, in a first position.
Figure 7:
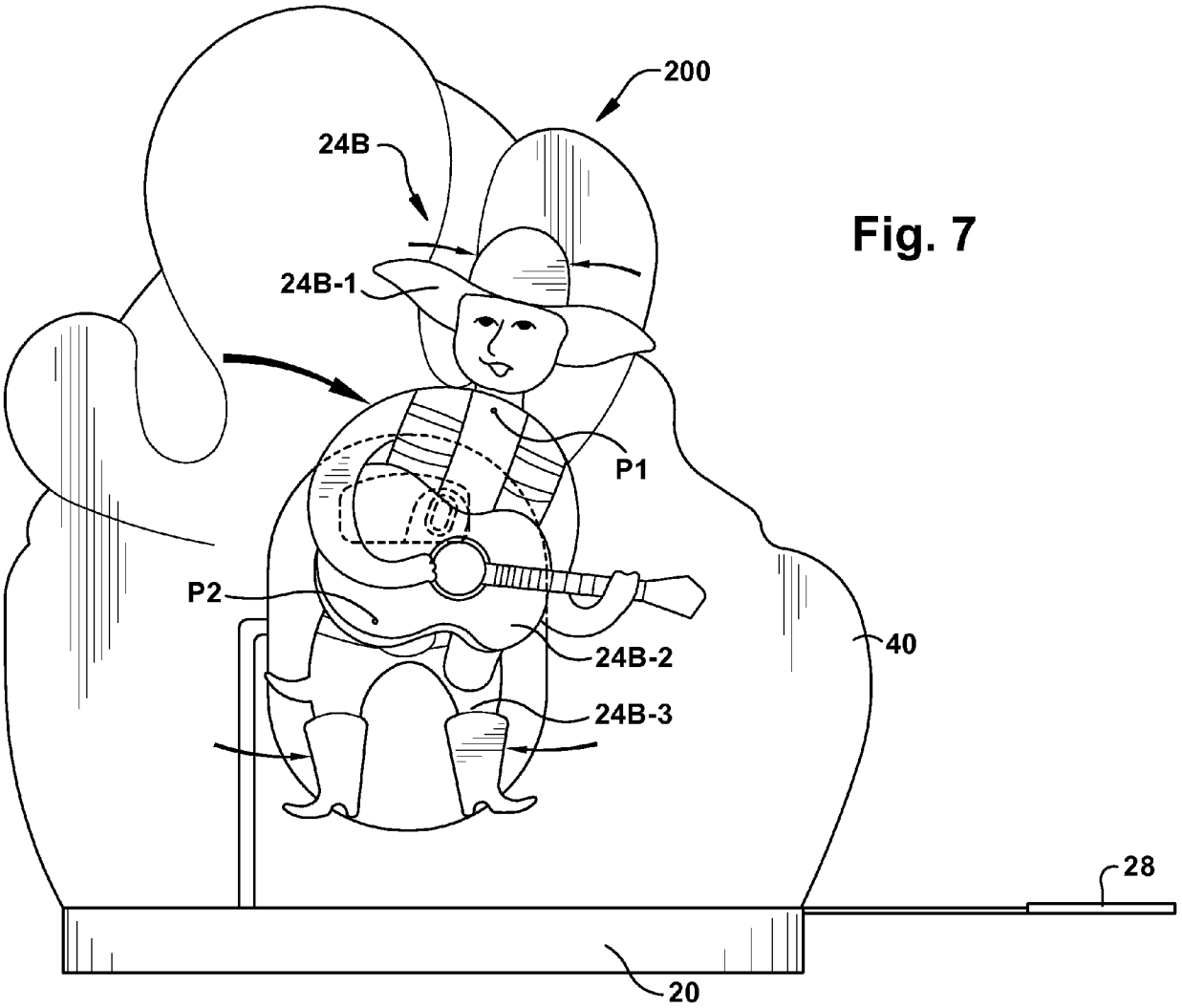
FIG. 7 is a front view of the mobile object of the motorized gift package accessory of FIG. 4, in a second position.

In a second embodiment, shown in FIGS. 4 through 7, the accessory portion 24 of the motorized gift package accessory 200 of the present invention is in the form of one or more interconnected die cut shapes 24B. The one or more die cut shapes 24B are the mobile element and they may be attached to a backing panel 40 and may be surrounded by other scenery such as static die-shaped cut-outs 42. In this embodiment, the motor module is contained in the backing panel 40 instead of the base structure 20. The backing panel 40, in a preferred embodiment, is similar to the base structure 20, in that it is a foam shape having a planar sheet material 22 attached to the front and rear surfaces thereof. The front and rear surface material 22 may contain printing thereon including but not limited to: text, drawings, photos, artwork, etc. The backing panel 40 extends upward from the base structure 20 in a perpendicular manner. In a preferred embodiment, the other electronic components (which were mentioned above) remain inside the base structure 20, with the motor 36 being connected to the circuit board 30, etc. through wiring between the backing panel 40 and base structure 20. Alternatively, all or some of the other electronic components may be contained in the backing panel 40 as well. The mobile object 24B consists of at least one, but preferably three die cut shapes. In a preferred embodiment, the mobile object 24B contains at least three die cut shapes 24B-1, 24B-2, 24B-3 attached at a pivot point P1, P2, wherein the three shapes 24B-1, 24B-2, 24B-3 are pivotable about the pivot point P1, P2 with respect to each other. Additional die cut shapes may also be connected to at least one of the at least three die cut shapes 24B-1, 24B-2, 24B-3 about the same or a different pivot point P1, P2. When the motor 36 is activated, setting the mobile object 24B in motion, the die cut shapes 24B-1, 24B-2, 24B-3 pivot or swing about the pivot points P1, P2, which simulates dancing or other such movement. The die cut shape 24B-1, 24B-2, 24B-3 can be shaped and decorated to resemble a character, such as the cowboy shown in the figures. The cowboy contains a head portion 24B-1, a body portion 24B-2 and a lower body or leg portion 24B-3 (the legs and head both attached to the body portion about separate pivot points P1, P2). When the motor 36 and sound modules are activated, the head 24B-1, body 24B-2 and legs 24B-3 pivot about their respective pivot points P1, P2, simulating the cowboy character dancing to the audio which is replayed through the speaker 34. The motor 36 may be of either of the types mentioned above or any other lightweight miniature motor. However, in a preferred embodiment, as shown in the figures, the motor 36 is of the type having a rotating gear mechanism 42 that when activated turns a circular gear 44. A connecting rod 46 is located between and connects the gear 44 and the mobile object 24B (through a hole or aperture in the backing panel 40). As the gear 44 is rotated by the gear mechanism 42, it in turn causes the moveable object 24B to move in a back-and-forth motion, as shown in the figures. FIG. 6 shows the connecting rod 46 in a first position wherein the mobile object 24B is tilting left and FIG. 7 shows the connecting rod 46 in a second position wherein the mobile object 34B is tilting right. When this motion is performed in a fast motion, the mobile object 24B appears to be dancing or moving in a side-to-side motion with the various die cut shapes 24B-1, 24B-2, 24B-3 pivoting about the respective pivot points P1, P2. In a slightly alternate embodiment, instead of having a mobile object with two or more die cut shapes attached at one or more pivot points, the mobile object may have two or more die cut shapes which connect, overlay or interact with each other to simulate a moving mouth of a character singing or talking. A first die cut shape may remain static while another strategically placed second die cut shape may be located behind and/or beneath the first die cut shape and may be attached to the motor so that when the motor is activated, the bottom or second die cut shape may move in an up-and-down direction simulating a moving mouth or lips. Other static die cut shapes 42 may be attached to the base structure 20 around the backing panel 40 and mobile object 24B. As shown in FIGS. 4 and 5, the die cut shapes 42 depict grass and hills which add to the scenery of the motorized gift package accessory 200. In this example, the backing panel 40 is shaped and decorated to resemble a cactus plant.

Both embodiments 100, 200 of the motorized gift package accessory described herein may be combined to form a gift package accessory having a pivoting die cut mobile object with a mobile bow, ribbon or other decorative accessory. The motorized gift package accessory may also contain more than one mobile object. Each embodiment or the combined embodiment may additionally contain one or more lights and/or confetti which is released upon some interaction with a user. The motorize gift package accessories described herein may additionally contain a microphone and record module operative to record, save and playback at least one personalized message recorded by a user. The at least one personalized message can be replayed before, during, after or in place of a pre-recorded audio file. The personalize message may be played before a pre-recorded audio file to, for example, introduce the pre-recorded audio clip or may be played after the pre-recorded audio file to, for example, leave a personalized message to end the audio experience, or the personalized message can be played simultaneously with the pre-recorded audio file, wherein a user may sing along to a pre-recorded song or instrumental audio clip, karaoke-style. The motorized gift package accessory of the present invention may also be part of (removable or permanently attached to) a gift bag, gift box or other type of gift container.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the examples are clearly within the scope of the invention where the invention is limited solely by the scope of the following claims.

What is claimed is:

1. A gift package accessory comprising:

a three-dimensional gift package accessory;

a base structure which contains and conceals a motor module operative to cause movement to the three-dimensional gift package accessory and a sound module operative to store and playback at least one audio file, the base structure having a backing layer on the bottom surface thereof which may be removed to expose an adhesive surface;

a press-button which operates as a toggle switch and controls activation and deactivation of the sound and motor module;

wherein the three-dimensional gift package accessory comprises at least two components which are attached to each other at a pivot point; and wherein the at least two components of the three-dimensional gift package accessory pivot or move about the pivot point when the motor module is activated.

2. The gift package accessory of claim 1, wherein the three-dimensional gift package accessory is arranged perpendicular to the base structure.

3. The gift package accessory of claim 1, wherein the base structure is made of foam.

4. The gift package accessory of claim 1, wherein the press-button is contained outside of the base structure.

5. The gift package accessory of claim 1, wherein the press-button is contained outside of the three-dimensional package accessory.

6. The gift package accessory of claim 1, wherein the three-dimensional gift package accessory further comprises a third component which is attached to one of the at least two components at a second pivot point.

7. A gift package accessory comprising:

a base structure operative to be attached to a gift package;

a backing panel attached perpendicular to the base structure;

a gift package accessory comprising two or more separate pieces, at least one of the two or more separate pieces attached to a motor contained within the backing panel, the gift package accessory comprising two or more pieces;

the motor operative to cause movement to the gift package accessory;

a switch operative to activate the motor.

8. The gift package accessory of claim 7, wherein the switch is a toggle switch.

9. The gift package accessory of claim 7, wherein the switch is a press-button switch.

10. The gift package accessory of claim 7 further comprising a sound module operative to store and playback at least one audio file.

11. The gift package accessory of claim 10, wherein the sound module is contained within the base structure.

12. The gift package accessory of claim 7, wherein the base structure contains a substantially planar top surface, a substantially planar bottom surface opposite the top surface, a perimeter surface which extends between all perimeter edges of the top and bottom surface, and a cavity between the top, bottom and perimeter surfaces.

13. The gift package accessory of claim 7, wherein when the motor module is activated, at least one of the at least two pieces of the gift package accessory move in an up-and-down motion.

14. The gift package accessory of claim 7, wherein the at least two pieces of the gift package accessory are die cut shapes.

15. A gift package accessory comprising:

a base structure having at least one cavity contained therein;

a backing panel extending upwards from the base structure, the backing panel having at least one cavity contained therein;

a gift package accessory attached to a motor, the gift package accessory comprising at least two separate pieces attached at a pivot point;

the motor module being contained within the cavity in the base structure or backing panel and operative to cause movement of the gift package accessory;

a switch operative to control activation of the motor module.

16. The gift package accessory of claim 15, wherein the switch is a press-button switch.

17. The gift package accessory of claim 15, wherein the switch is contained outside of the base structure.

18. The gift package accessory of claim 15, wherein the switch is attached to the base structure.

19. The gift package accessory of claim 15 further comprising a sound module operative to store and playback at least one audio file.

20. The gift package accessory of claim 15, wherein the base structure contains a backing layer on a bottom surface thereof which may be removed to expose an adhesive surface.

* * * * *